US006116930A

United States Patent [19]

Sakata

[11] Patent Number: 6,116,930

[45] Date of Patent: Sep. 12, 2000

[54] ROTARY CONNECTION UNIT

[75] Inventor: Tomoyuki Sakata, Nagoya, Japan

[73] Assignees: Harness System Technologies, Nagoya; Sumitomo Wiring Systems, Ltd, Mie; Sumitomo Electronic Industries, Ltd., Osaka, all of Japan

[21] Appl. No.: 09/210,934

[22] Filed: Dec. 15, 1998

[30] Foreign Application Priority Data

Dec. 17, 1997 [JP] Japan ..... 9-348156

[51] Int. Cl.[7] ..... H01R 35/04

[52] U.S. Cl. ..... 439/164; 439/15

[58] Field of Search ..... 439/164, 15

[56] References Cited

U.S. PATENT DOCUMENTS

| | | | |
|---|---|---|---|
| 3,579,721 | 5/1971 | Kaltenbach . | |
| 5,409,389 | 4/1995 | Shibata et al. . | |
| 5,649,832 | 7/1997 | Wolf | 439/164 |
| 5,653,604 | 8/1997 | Sakakibara | 439/164 |
| 5,674,082 | 10/1997 | Okuhara et al. . | |

FOREIGN PATENT DOCUMENTS

| | | |
|---|---|---|
| 0 775 611 A2 | 5/1997 | European Pat. Off. . |
| 0 775 611 A3 | 5/1997 | European Pat. Off. . |
| 42 11 264 A 1 | 8/1992 | Germany . |
| 2-215071 | 8/1990 | Japan . |

*Primary Examiner*—Gary F. Paumen
*Attorney, Agent, or Firm*—Oliff & Berridge, PLC

[57] ABSTRACT

A rotary connection unit includes a fixed-side member, a rotary-side member rotatable to the fixed-side member around a central rotational axis, the rotary-side member and the fixed-side member defining an annular space, and a cable received in the space in such a manner that one end portion thereof is held by the fixed-side member, and the other end portion thereof is held by the rotary-side member. The space has a winding surface on which the cable is wound to a predetermined direction at a predetermined taper angle with respect to the central rotational axis. The cable is received in the space in such a manner that the cable is folded back midway so that the cable is wound to a direction opposite to the predetermined direction.

8 Claims, 9 Drawing Sheets

ROTARY CONNECTION UNIT

BACKGROUND OF THE INVENTION

1. Field of the Invention

The present invention relates to a rotary connection unit for use in electrically connecting two parts relatively rotating in automobiles, home electric equipment and the like.

2. Description of the Related Art

In such an automotive steering wheel mount as shown in FIGS. 7 and 8, for example, a steering shaft 2 is rotatably supported with a bracket 1 fixed to a body, whereas a switch unit 3 and a rotary connection unit 4 are installed on the surface of the bracket 1. Moreover, a steering wheel 6 rotating together with the shaft 2 is fitted to the fore-end of the steering shaft 2 passed through these switch unit 3 and the rotary connection unit 4 and projected upward. Furthermore, the steering wheel 6 is provided with electric equipment 7 such as a horn switch and an air bag as occasion demands. The switch unit 3 incorporates, for example, a turn signal lamp switch, a wiper switch and the like, operating levers 8, 9 for turning on and off the switches being each fitted to the left and right sides of the switch unit 3.

The aforesaid rotary connection unit 4 is a unit for electrically connecting the electric equipment 7 making a rotary movement together with the steering wheel 6 to a circuit on the body side and has heretofore been so configured as shown below by way of example.

In a first conventional rotary connection unit shown in FIGS. 9A–11, a cable (flexible flat cable; FFC) 13 is contained in an annular space 12 between a fixed-side member 10 fixed to the body side and a rotary-side member 11 rotating together with the steering wheel 6 in such a manner that the cable is spirally wound on the rotary-side member 11; a connector 15 fitted to the outer end portion of the cable 13 is connected to a connector 16 installed on the side of the bracket 1 as shown in FIG. 8; and a connector 17 fitted to the inner end portion of the cable 13 is connected to a connector 18 provided to the electric equipment 7. As shown in FIG. 9A, the cable 13 is wound around the outer peripheral portion of the rotary-side member 11 when the rotary-side member 11 is rotated clockwise and as shown in FIG. 9B, whereas the cable 13 is rewound in such a manner as to creep along the side wall of the fixed-side member 10 when the rotary-side member 11 is rotated counterclockwise. Thus, an electric circuit on the body side and the electric equipment 7 of the steering wheel 6 are kept electrically contacting each other even though the fixed-side member 10 and the rotary-side member 11 are relatively rotated.

As shown in FIGS. 10A and 10B, therefore, there are some rotary connection units having a rotary guide 20 for reversing the direction of winding the cable 13 midway so as to make movable the reversing portion in conjunction with the rotation of the rotary-side member 11. This arrangement is contrary to what is shown in FIG. 9 in that the cable 13 is rewound in such a manner as to creep along the side wall of the fixed-side member 10 when the rotary-side member 11 is rotated clockwise as shown in FIG. 10A, whereas the cable 13 is round around the outer peripheral portion of the rotary-side member 11 when the rotary-side member 11 is rotated counterclockwise as shown in FIG. 10B. With this arrangement, the whole length of the cable 13 can be made shorter than that of the cable 13 shown in FIG. 9 by reversing the direction of winding the cable 13 midway.

As shown in FIG. 11, the cable 13 wound around the central axis of rotation is made flat by arranging a plurality of conductors in the direction of a central rotational axis 19, that is, in the direction of a vertical rotational axis. Therefore, the width in the direction of the central rotational axis 19 of the cable 13 becomes greater when the number of conductors of the cable 13 is increased and in the case of a rotary connection unit for an automotive steering wheel mount, it becomes difficult to secure a space in which the rotary connection unit is assembled. Moreover, the troublesome step of winding the cable 13 is needed at the time of assembly and though the end portion of the conductor of the cable 13 has heretofore been connected directly to an electric circuit or indirectly via connectors thereto at the time assembly, these sorts of work are also laborious and result in necessitating hours to do assembling work.

Although the use of a flexible print circuit (FPC) in place of the aforesaid FFC as the cable 13 is considered feasible, the problem is that the whole length of the cable 13 may become as long as approximately two meters, thus making the manufacture of a cable of this sort extremely difficult.

In the case of a second conventional rotary connection unit shown in FIGS. 12 and 13, on the other hand, a plurality of conductors are lined up in parallel within a plane intersecting the aforesaid central rotational axis 19 in the cable 13 (FFC or FPC) and the cable 13 is spirally formed in parallel to the well-ordering plane of the conductors. Moreover, the cable 13 is folded back in the intermediate portion of the rotary guide 20 so that its spiral direction is reversed. In this case, one end portion 13*a* of the cable 13 maybe held by the fixed-side member 10 and the other end portion 13*b* is held by the rotary-side member 11 (see Japanese Patent Unexamined Publication No. 215071/1990).

Since the width in the direction of the central rotational axis is unchanging even though the number of conductors of the cable 13 is increased in the case of the second conventional example, the size of the rotary connection unit 4 in the direction of the central rotational axis is restrained from being increased and the work of spirally winding the cable 13 can be dispensed with. This is advantageous as the coils of the cable are prevented from becoming loosened.

However, the second conventional example poses a problem in that though the size of the rotary connection unit 4 in the direction of the central rotational axis 19 remains unchanging, its size in a direction perpendicular to the central rotational axis 19 conversely tends to increase.

SUMMARY OF THE INVENTION

An object of the present invention in view of the aforesaid situation is to provide such a rotary connection unit installed in an automotive steering wheel mount, for example, that its size is restrained from becoming extremely large in the direction of a central rotational axis and in a direction perpendicular to the central rotational axis both even though the number of conductors of a cable is increased.

In order to solve the foregoing problems, a rotary connection unit according to the present invention including a fixed-side member, a rotary-side member rotatable to the fixed-side member around a central rotational axis, the rotary-side member and the fixed-side member defining an annular space, and a cable received in the space in such a manner that one end portion thereof is held by the fixed-side member, and the other end portion thereof is held by the rotary-side member. The space has a winding surface on which the cable is wound to a predetermined direction at a predetermined taper angle with respect to the central rotational axis. The cable is received in the space in such a manner that the cable is folded back midway so that the cable is wound to a direction opposite to the predetermined direction.

According to the present invention, a flexible print circuit (hereinafter called the FPC) is formed so that the FPC is formed in a substantially C-form within a plane perpendicular to the central rotational axis and then the FPC is wound one over the other so as to provide a predetermined taper angle with respect to the central rotational axis and the cable is contained in the space in such a manner that its midportion is folded back so as to reverse the direction in which the cable is wound one over the other.

Further, it is preferred that a rotary guide is provided which is formed in between the fixed-side member and the rotary-side member and made rotatable with respect to both the members and used to guide the movement of the folded back portion of the cable.

In addition, a wiring portion having a contact to which an electric part may be formed integrally in the end portion of the cable.

Further, a part-packaging wiring portion is formed integrally in the end portion of the cable.

BRIEF DESCRIPTION OF THE DRAWINGS

Similar reference characters denote corresponding features consistently throughout the attached figures. The preferred embodiments of this invention will be described in detail, with reference to the following figures, wherein.

DETAILED DESCRIPTION OF THE PREFERRED EMBODIMENTS

Figure 1:
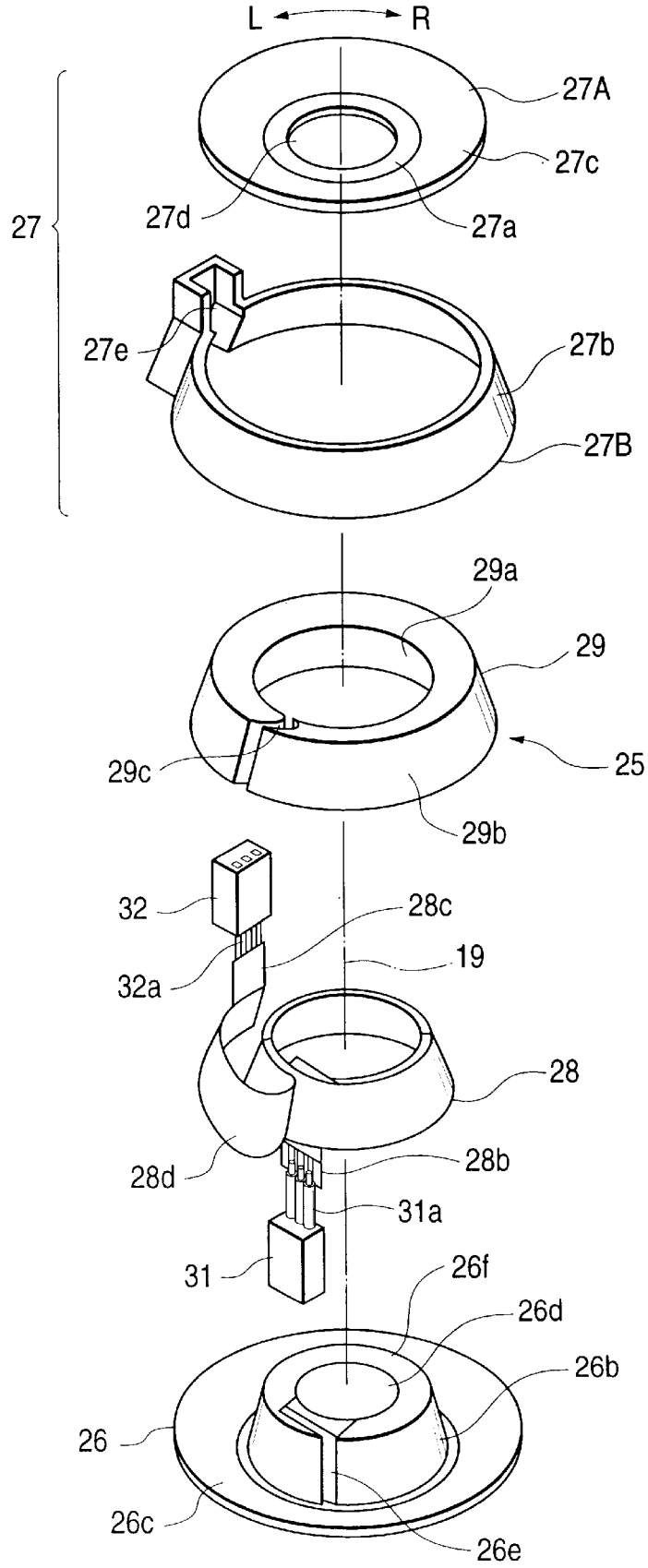
FIG. 1 is an exploded perspective view of a rotary connection unit according to the present invention.

A description will subsequently be given of a preferred mode for carrying out the invention with reference to the drawings, wherein like reference characters designate like or corresponding parts in the related art and the detailed description thereof will be omitted.

Figure 2:
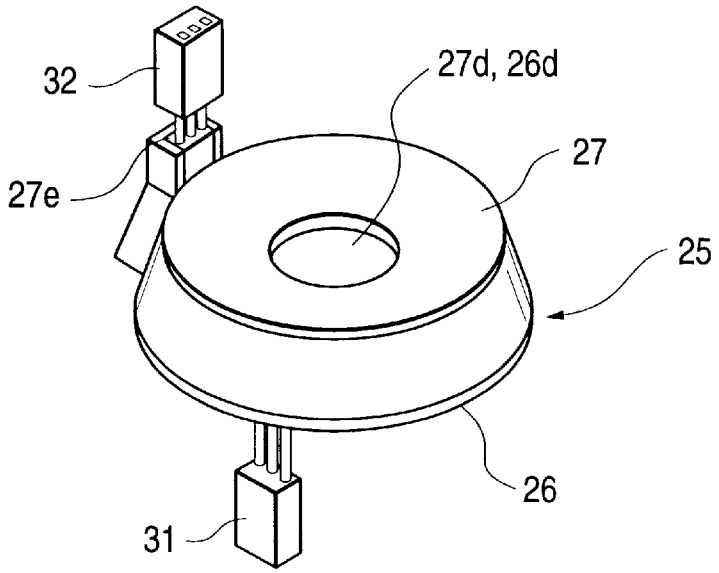
FIG. 2 is a perspective view of assembling the rotary connection unit.
Figure 3:
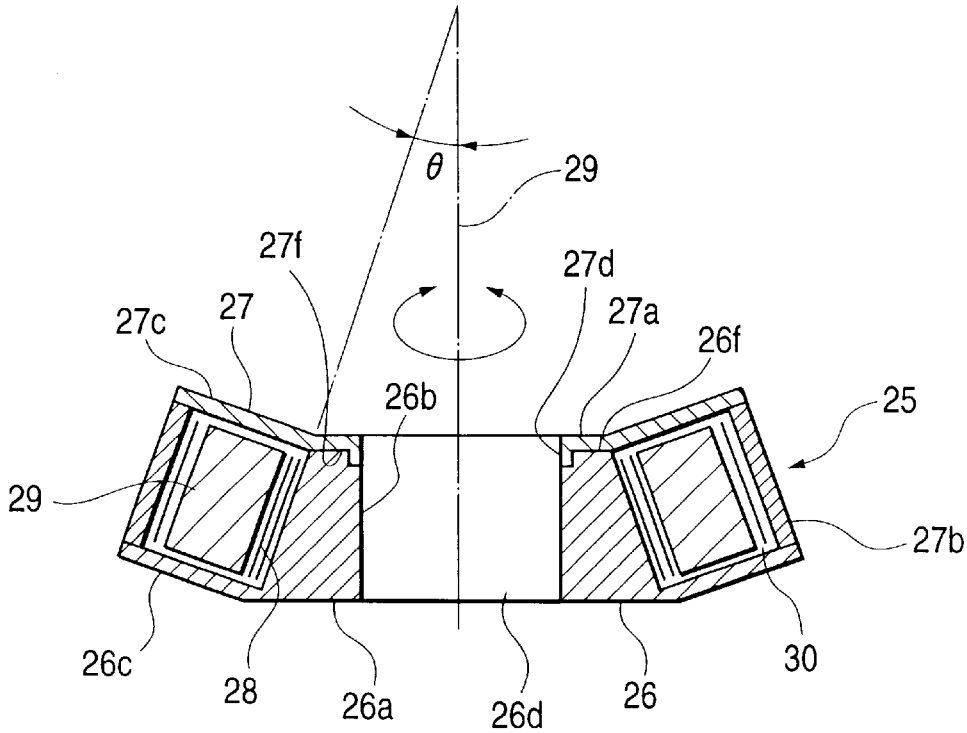
FIG. 3 is a sectional view of the rotary connection unit.

As shown in FIGS. 1–3, a rotary connection unit 25 includes a lower case member 26 as a fixed-side member and an upper case member 27 as a rotary-side member. A cable 28 and a rotary guide 29 are received in a case formed by combining both the case members 26, 27.

The lower case member 26 is formed with a flat base portion 26*a* intersecting the aforesaid central rotational axis 19 at right angles, a tapered inner wall portion 26*b* vertically extending at a predetermined taper angle θ (θ=20° in an example of FIG. 3) with respect to the central rotational axis 19 and a tilted base portion 26*c* projecting outward from the flat base portion 26*a* in a manner intersecting the tapered inner wall portion 26*b* at right angles. Furthermore, there is provided with a slit-like cable drawing portion 26*e* communicating with a central hole 26*d* through which the aforesaid steering shaft 2 is passed.

The upper case member 27 is formed with a flat top portion 27*a* parallel to the flat base portion 26*a* of the lower case member 26, a tilted top portion 27*c* parallel to the tilted base portion 26*c* of the lower case member 26 and a tapered outer wall portion 27*b* parallel to the tapered inner wall portion 26*b* of the lower case member 26. A central hole 27*d* through which the steering shaft 2 is passed is formed in the flat top portion 27*a* and a connector holding portion 27*e* for simultaneous use as a cable drawing portion is formed in the tapered outer wall portion 27*b*.

The upper case member 27 is assembled from not only a member 27A formed with the flat top portion 27*a* and the tilted top portion 27*c* but also a member 27B formed with the tapered outer wall portion 27*b* and the cable holding portion 27*e*.

When both case members 26, 27 are assembled into a combined unit in such a state that the underside 27*f* of the flat top portion 27*a* of the upper case member 27 is put on the top 26*f* of the flat base portion 26*a* of the lower case member 26, an annular space 30 is formed in between both the case members 26, 27.

Figure 4A:
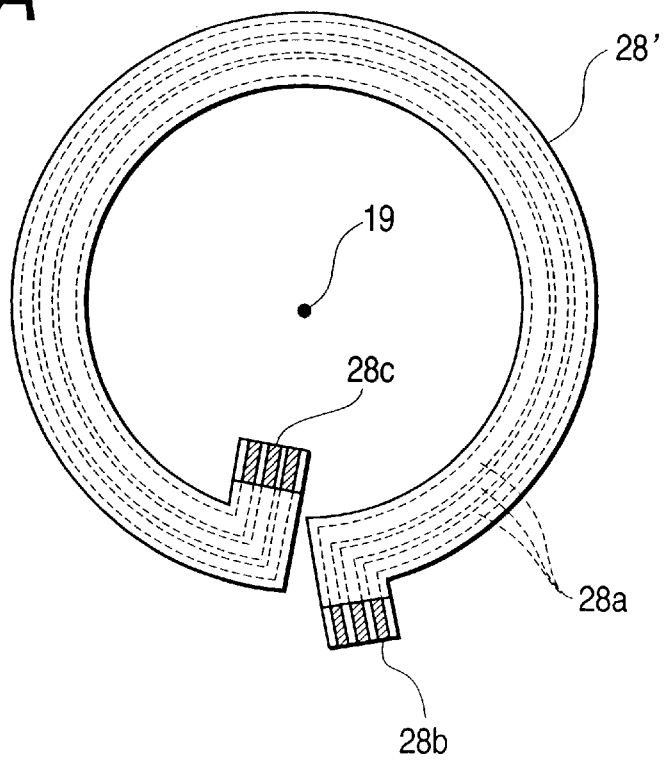
FIG. 4A is a plan view of a cable.

The cable 28 is such that, as shown in FIG. 4A illustrating its developed state at the time of forming, FPC 28' is formed so that it is substantially C-shaped in a plane perpendicular to the central rotational axis 19. As is well known, this FPC 28' is prepared by covering a plurality of copper foil patterns (conductors) 28*a* with flexible insulating sheets and can be manufactured by cutting, by means of a molding tool, the substantially C-shaped copper foil patterns 28*a* covered with the insulating sheets in line with the configuration of the copper foil patterns 28*a*.

The one end portion (right-hand side in FIG. 4A) of the FPC 28' is bent outward by 90° to form the connecting end portion 28*b* of the lower case member 26 with part of the copper foil patterns 28*a* being exposed, whereas the other end portion thereof is bent inward by 90° to form the connecting end portion 28*c* of the upper case member 27 with part of the copper foil patterns 28*a* being exposed.

As shown in FIG. 1, the cable 28 is formed by winding the FPC 28' so that the aforesaid taper angle θ is formed with respect to the central rotational axis 19 and this cable 28 is received in the space 30 formed with both case members 26, 27 in such a state that the cable 28 is folded back midway to reverse the direction of winding it.

The terminals 31*a*, 32*a* of the respective connectors 31, 32 are connected to the copper foil patterns 28*a* of the connecting end portions 28*b*, 28*c* of the cable 28 by caulking, welding, soldering or the like, respectively. Electric wires drawn from the connectors 31, 32 may be connected thereto in this case.

While the connector 31 is positioned in the central hole 26*d* of the lower case member 26, the connecting end portion 28*b* of the cable 28 is drawn downward as well as outward from the cable drawing portion 26*e*, whereby the connecting end portion 28*b* is held by the lower case member 26. Additionally, while the connector 32 is positioned outside the cable holding portion 27*e* of the upper case member 27, the connecting end portion 28*c* of the cable 28 is drawn upward as well as outward from the cable holding portion 27*e*, whereby the connecting end portion 28*c* is held by the upper case member 27.

The rotary guide 29 is formed by making a diametric cutout 29*c* communicating the inner peripheral face 29*a* of the central hole with its outer peripheral face 29*b* in a doughnut-type disc with predetermined wall thickness. The rotary guide 29 is incorporated in the space 30 so that it is positioned between the outer- and inner-side portions of the cable 28 and made rotatable with respect to the upper case member 27 as well as the lower case member 26.

The folded back portion 28*d* of the cable 28 is passed through the cutout 29*c* whose wall surface is curved in order that the folded back portion 28*d* may be continuously and smoothly curved.

In a case where the rotary connection unit 25 is employed for a steering wheel mount, the lower case member 26 is fixed to the bracket 1 and the upper case member 27 is fitted to the steering wheel 6 integrally rotatable therewith. The steering shaft 2 is passed through the central hole 26*d* of the lower case member 26 and the central hole 27*d* of the upper case member 27.

Then the connecting end portion 28*b* of the cable 28 is drawn from the cable drawing portion 26*e* of the lower case member 26 and its connector 31 coupled to the body-side connector. Furthermore, the connecting end portion 28*c* of the cable 28 is drawn from the cable holding portion 27*e* of the upper case member 27 whereby to couple its connector 32 to the connector of the electric equipment 7 provided to the steering wheel 6.

Thus, the connectors 31, 32 are fitted to the respective connecting end portions 28*b*, 28*c*, and the cable 28 and an external electric circuit are connected together via the connectors 31, 32 in order to secure compatibility therebetween.

When the steering wheel 6 is operated R clockwise, the upper case member 27 is turned clockwise with respect to the lower case member 26 and the folded back portion 28*d* of the cable 28 is successively moved outside, whereby the cable 28 is paid out outside the rotary guide 29, that is, to a position along the tapered outer wall portion 27*b* of the upper case member 27.

When the steering wheel 6 is operated L counterclockwise, the upper case member 27 is turned counterclockwise with respect to the lower case member 26 and the folded back portion 28*d* of the cable 28 is successively moved inside, whereby the cable 28 is paid out to the inside of the rotary guide 29, that is, to a position along the tapered inner wall portion 26*b* of the lower case member 26.

The rotary guide 29 is rotated with respect to the upper case member 27 and the lower case member 26 in response to the rotation of the upper case member 27, so that the folded back portion 28*d* of the cable 28 is moved. The cable 28 itself is not moved within the winding plane but only moved between the position along the lower case member 26 and the position along the upper case member 27.

Moreover, the provision of the rotary guide 29 prevents not solely the outside and inside portions of the cable 28 from interfering with each other but also the folded back portion 28*d* from being twisted and turned to thereby ensure that the cable 28 is smoothly moved from the lower case member 26 to the upper case member 27 or vice versa without the slacking of the cable 28. Incidentally, the rotary guide 29 is preferably made of light material such as plastics but also made lightweight by hollowing out it.

Since the cable 28 is in a tapered form, its size is not increased in the direction of the central rotational axis 19 in comparison with the first conventional example and not extremely increased in a direction perpendicular to the central rotational axis 19 in comparison with the second conventional example, even though the number of conductors (the number of copper foil patterns) of the cable 28 is increased.

Since the wiring portion having the copper foil patterns 28*a* (contacts) with part thereof exposed so that it may be connected to the terminals 31*a*, 32*a* of the connectors (electric parts) 31, 32 is integrally formed with the respective connecting end portions 28*b*, 28*c* of the cable 28, it is unnecessary to connect another wiring portion to the respective connecting end portions 28*b*, 28*c* of the cable 28.

Figure 4B:
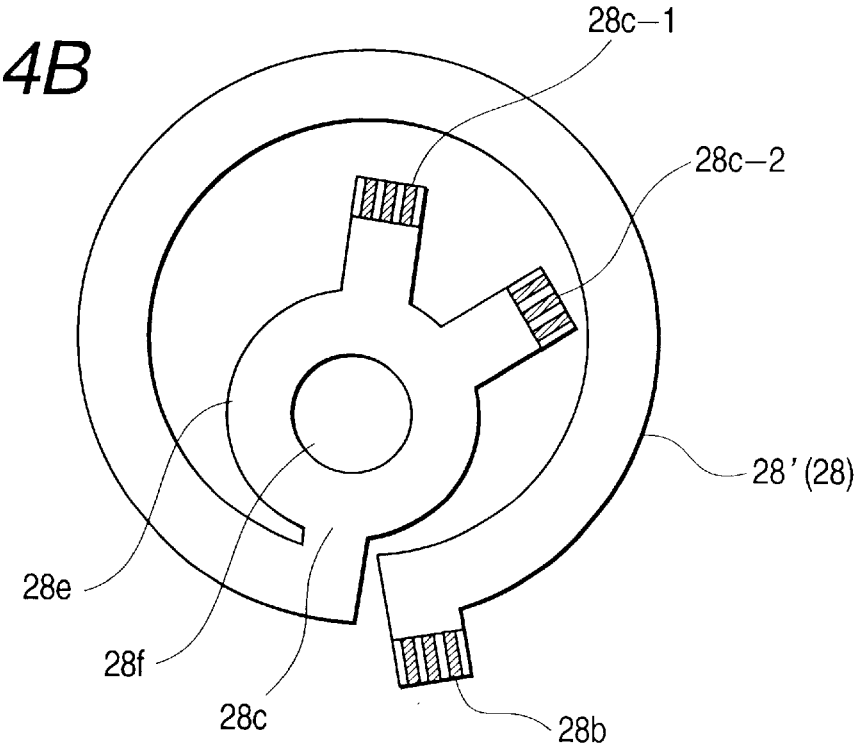
FIG. 4B is a plan view of a cable of a modified example.
Figure 5:
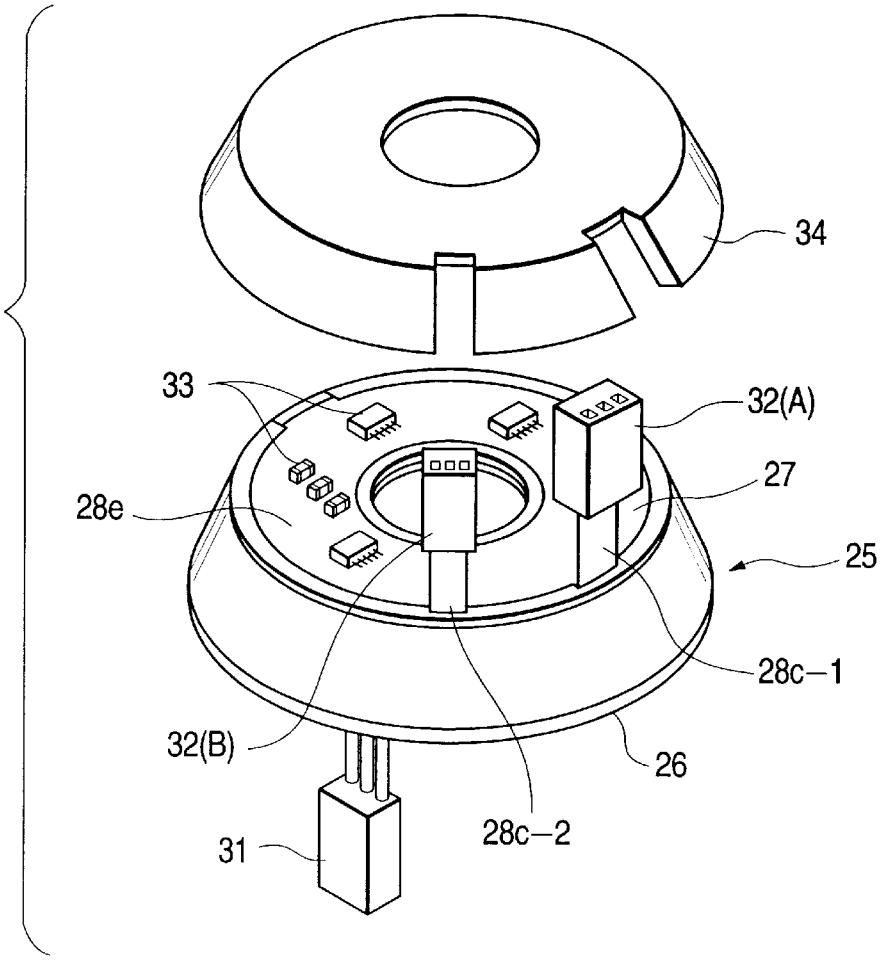
FIG. 5 is a perspective view of assembling the modified example of the rotary connection unit.
Figure 6:
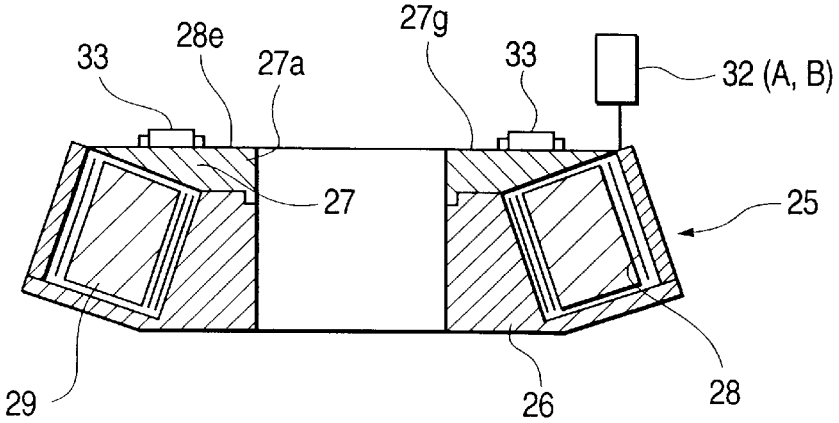
FIG. 6 is a sectional view of the rotary connection unit as a modified example.
Figure 7:
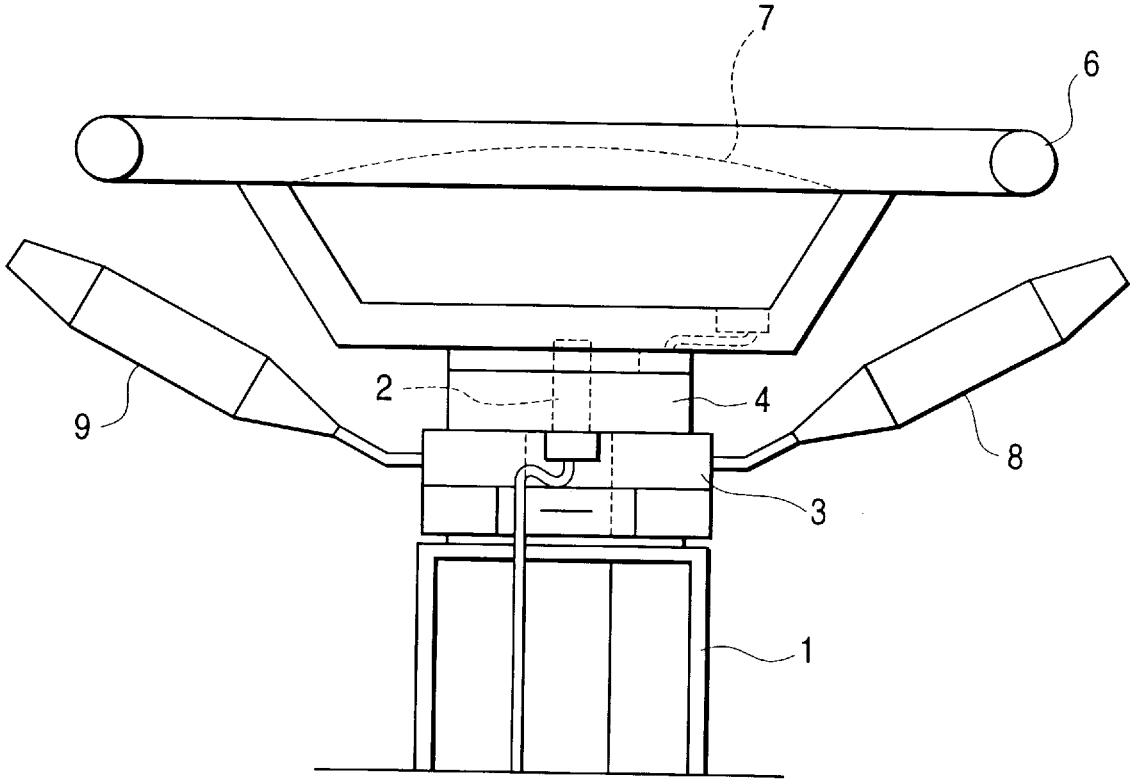
FIG. 7 is an elevational view of an automotive steering wheel mount.
Figure 8:
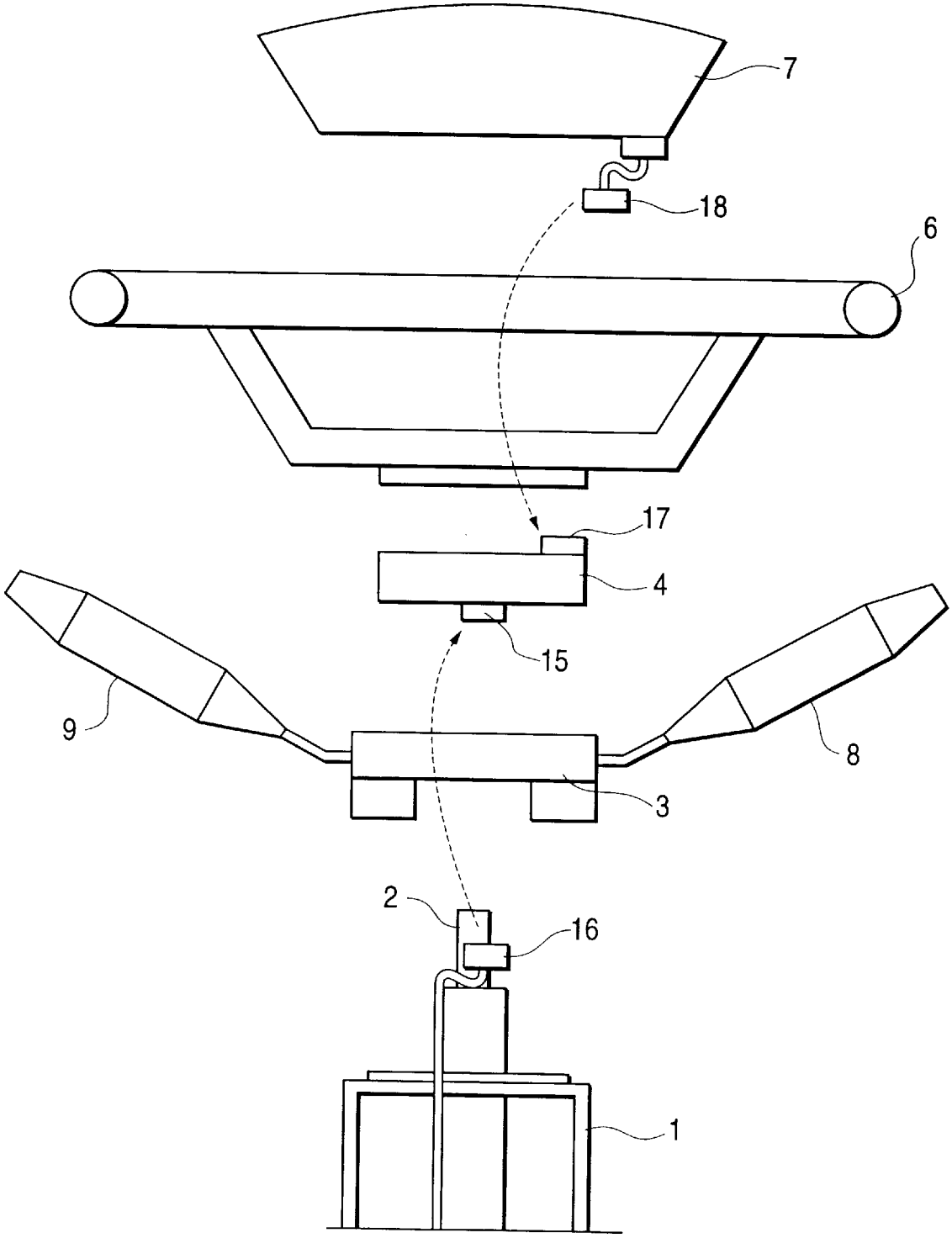
FIG. 8 is an exploded view of the automotive steering wheel mount.
Figure 9A:
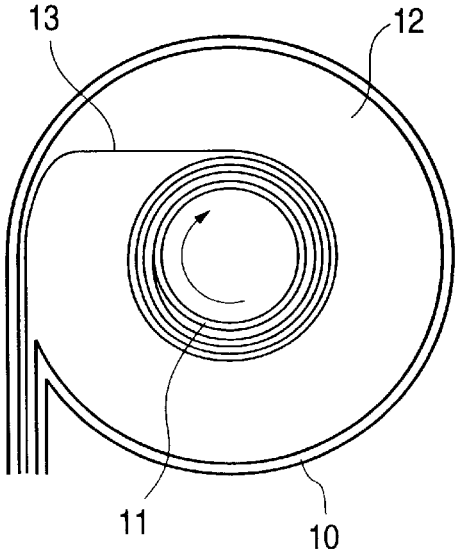
FIGS. 9A and 9B are diagrams illustrating different conditions of a first conventional rotary connection unit.
Figure 9B:
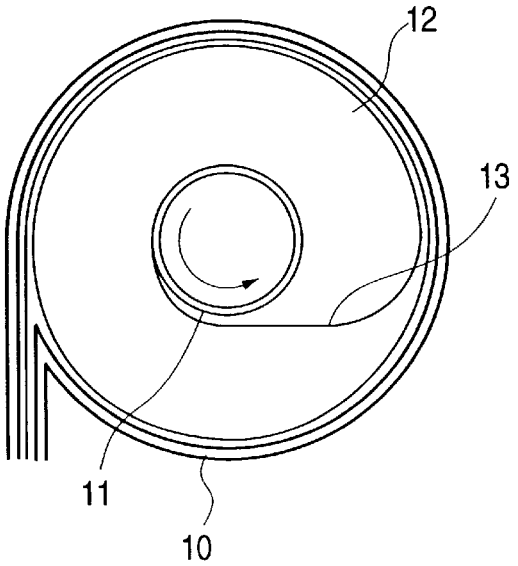
Figure 10A:
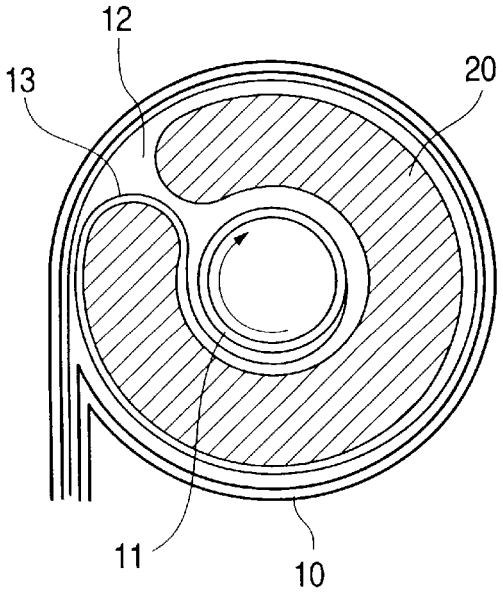
FIGS. 10A and 10B are diagrams illustrating different conditions of a rotary connection unit different from what is shown in FIGS. 9A and 9B.
Figure 10B:
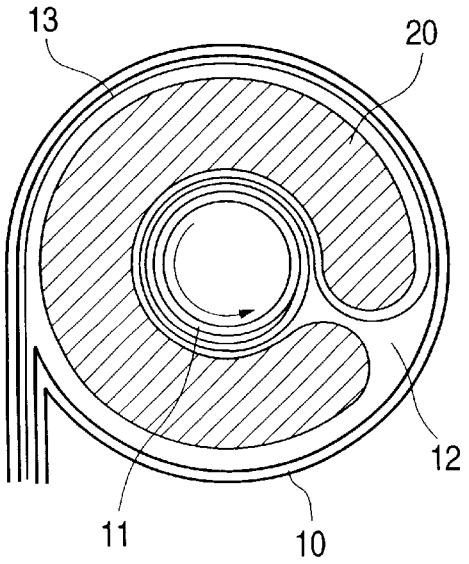
Figure 11:
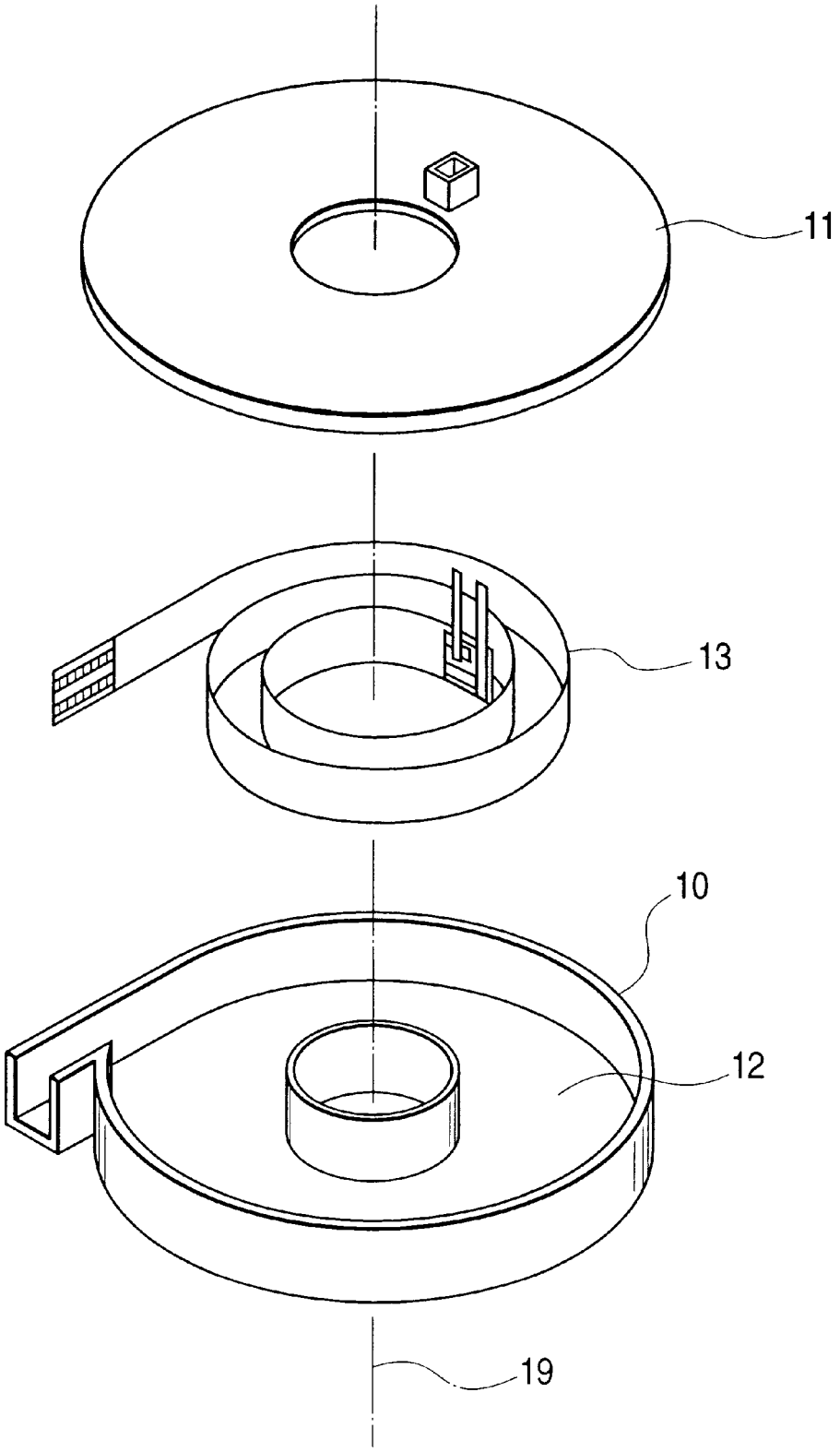
FIG. 11 is an exploded view of the rotary connection unit shown in FIGS. 9A and 9B.
Figure 12:
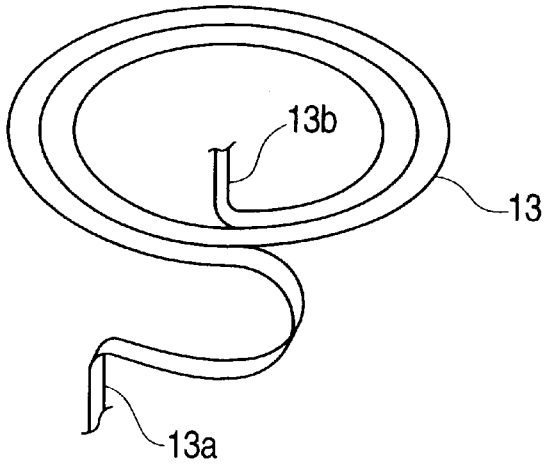
FIG. 12 is a perspective view of a cable of a second conventional rotary connection unit.
Figure 13:
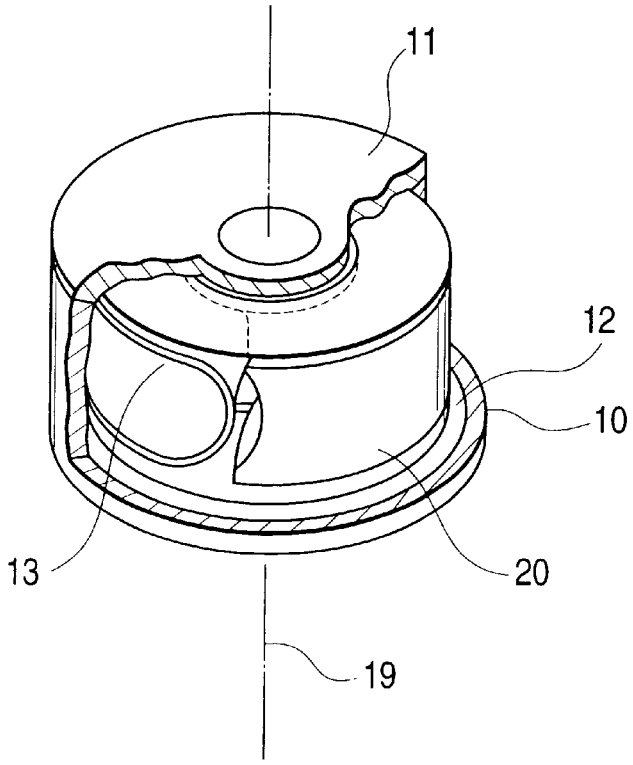
FIG. 13 is a cutaway perspective view of the principal part of the rotary connection unit shown in FIG. 12.

As shown in FIGS. 5 and 6, the top portion 27*g* of the flat top portion 27*a* of the upper case member 27 is made flat and by extending the connecting end portion 28*c* of the cable 28 as shown in FIG. 4B, there is formed an annular wiring portion 28*e* which has a hole 28*f* synchronous with the central hole 27*d* and is mounted on the top 27*g* of the flat top portion 27*a*. On the other hand, connecting end portions 28*c*-1, 28*c*-2 for use in connecting terminals 32*a* of a plurality of connectors 32 (A), 32 (B) with each other are integrally formed. Reference numeral 34 denotes a cover for covering the wiring portion 28*e*.

Consequently, the wiring portion 28*e* for packaging the plurality of electric parts 33 is integrally formed with the connecting end portion 28*c* of the cable 28, whereby it can be dispensed with to provide a substrate for use in packaging separate electric parts. Thus, the number of parts becomes reducible and simultaneously the terminals 32*a* of the plurality of connectors 32(A), 32(B) can be connected together.

In the present invention, the structure which the cable is wound in a tapered form may be applied to the rotation connection unit having no rotary guide.

Further, as shown in FIG. 4A, although the cable is formed in a substantially C-shaped in a plane perpendicular to the central rotational axis, the cable of the present invention may be formed in an annular shape in a plane perpendicular to the central rotational axis and the curvature of the C-shaped cable can be set according to the size or taper angle of the tapered inner wall portion.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modifications may be made thereto without departing from the spirit and scope of the invention.

As is obvious from the above description, since the rotary connection unit is such that the cable is formed by winding the FPC which is formed, one over the other, in the substantially C-form within the plane perpendicular to the central rotational axis and has the predetermined taper angle with respect to the central rotational axis, the cable in the tapered form is not large-sized in the direction of the central rotational axis as compared with the aforesaid first conventional example and not large-sized in a direction perpendicular to the direction of the central rotational axis as also compared with the aforesaid second conventional example even though the number of conductors of the cable increases. In addition to the advantages above, the rotary connection unit according to the present invention is fit for use in a rotary portion where a number of electric wires are provided in between the fixed- and rotary-sides.

The provision of the rotary guide for guiding the movement of the folded back portion of the cable in between the fixed- and rotary-side members makes smooth the movement of the folded back portion.

The integral formation of the wiring portion having a contact to which an electric part is connected in the end portion of the cable makes it unnecessary to connect another separate wiring portion to the end portion of the cable. Further, the integral formation of the part-packaging wiring portion in the end portion of the cable can make it unnecessary to provide another separate part-packaging substrate, whereby the number of parts becomes reducible and the assembling work can also be simplified.

What is claimed is:

1. A rotary connection unit comprising:

a fixed-side member;

a rotary-side member rotatable to the fixed-side member around a central rotational axis; the rotary-side member and the fixed-side member defining an annular space; and a cable received in the space in such a manner that one end portion thereof is held by the fixed-side member, and the other end portion thereof is held by the rotary-side member, wherein the space has a winding surface on which the cable is wound to a predetermined direction at a predetermined taper angle with respect to the central rotational axis, and the cable is received in the space in such a manner that the cable is folded back midway so that the cable is wound to a direction opposite to the predetermined direction.

2. A rotary connection unit as claimed in claim 1, further comprising:

a rotary guide provided in the space so as to be rotatable to the fixed-side member and the rotary-side member, and having a slit guiding the movement of a folded back portion of the cable.

3. A rotary connection unit as claimed in claim 1, wherein the cable is a flexible print circuit formed in a substantially C-shape in a plane perpendicular to the central rotational axis.

4. A rotary connection unit as claimed in claim 1, wherein the fixed-side member has an annular tilted bottom surface substantially orthogonal to the winding surface and the rotary-side member has an annular tilted top surface substantially parallel to the tilted bottom surface, whereby the winding surface, the tilted bottom surface and the tilted top surface define the annular space.

5. A rotary connection unit as claimed in claim 1, wherein at least one of the one end portion and the other end portion of the cable is integrally formed with a wiring portion having a contact to which an electric part is connected.

6. A rotary connection unit as claimed in claim 1, wherein wherein at least one of the one end portion and the other end portion of the cable is integrally formed with a part-packaging wiring portion.

7. A rotary connection unit comprising:

a fixed-side member;

a rotary-side member rotatable to the fixed-side member around a central rotational axis; and a cable having one end portion held by the fixed-side member and the other end portion held by the rotary-side member, wherein the rotary-side member has a winding surface for winding the cable, tilted at a predetermined taper angle with respect to the central rotational axis and a tilted bottom surface extending substantially perpendicular to the winding surface, and the fixed-side member has a tilted top surface substantially parallel to the tilted bottom surface, whereby the cable is received in a space defined by the winding surface, the tilted bottom surface and the tilted top surface.

8. A rotary connection unit as claimed in claim 7, wherein the cable is a flexible print circuit formed in a substantially C-shape in a plane perpendicular to the central rotational axis.

* * * * *